US010518928B2

(12) United States Patent
Reiter

(10) Patent No.: US 10,518,928 B2
(45) Date of Patent: Dec. 31, 2019

(54) BEVERAGE CONTAINER WITH AN AEROSOL EMITTING DEVICE

(71) Applicant: Harald Reiter, Telfs (AT)

(72) Inventor: Harald Reiter, Telfs (AT)

( * ) Notice: Subject to any disclaimer, the term of this patent is extended or adjusted under 35 U.S.C. 154(b) by 317 days.

(21) Appl. No.: 15/527,102

(22) PCT Filed: Nov. 20, 2015

(86) PCT No.: PCT/EP2015/002328
§ 371 (c)(1),
(2) Date: May 16, 2017

(87) PCT Pub. No.: WO2016/078769
PCT Pub. Date: May 26, 2016

(65) Prior Publication Data

US 2019/0092519 A1 Mar. 28, 2019

(30) Foreign Application Priority Data

Nov. 21, 2014 (DE) ..... 10 2014 017 320

(51) Int. Cl.
*B65D 17/28* (2006.01)
*B65D 51/24* (2006.01)

(52) U.S. Cl.
CPC ..... *B65D 17/4012* (2018.01); *B65D 51/245* (2013.01); *B65D 51/248* (2013.01); *B65D 2517/0014* (2013.01); *B65D 2517/0053* (2013.01); *B65D 2517/0056* (2013.01); *B65D 2517/0071* (2013.01)

(58) Field of Classification Search
CPC ..... B65D 81/3205; B65D 17/4012; B65D 51/248; B65D 81/3211; B65D 81/3216
USPC ..... 206/219
See application file for complete search history.

(56) References Cited

U.S. PATENT DOCUMENTS 3,305,368 A * 2/1967 Bourelle ..... B65D 81/3216 206/219
5,584,165 A * 12/1996 Wright ..... B65D 85/73 426/115
5,711,420 A * 1/1998 Spring ..... B65D 81/3205 206/222

FOREIGN PATENT DOCUMENTS

DE 10064572 A1 5/2002
DE 102011106132 A1 3/2012
DE 202012005045 U1 6/2012

OTHER PUBLICATIONS

International Search Report dated Jan. 28, 2016 in PCT/EP2015/002328.

* cited by examiner

*Primary Examiner* — Jeffrey R Allen
(74) *Attorney, Agent, or Firm* — Fay Sharpe LLP

(57) ABSTRACT

A beverage container with aerosol-emitting device, comprising an opening device arranged on an outer side of the beverage container for opening a drink-through opening cover and an aerosol-emitting device attached to an outer side of the beverage container, which aerosol-emitting device comprises a pressure container for receiving and storing a pressurized propellant gas and a substance to be emitted, a nozzle fluidly connected to the pressure container for emitting an aerosol formed from the propellant gas and the substance to be emitted, and a triggering device for opening the nozzle, which releases the aerosol upon actuation.

19 Claims, 4 Drawing Sheets

BEVERAGE CONTAINER WITH AN AEROSOL EMITTING DEVICE

Figure 1:
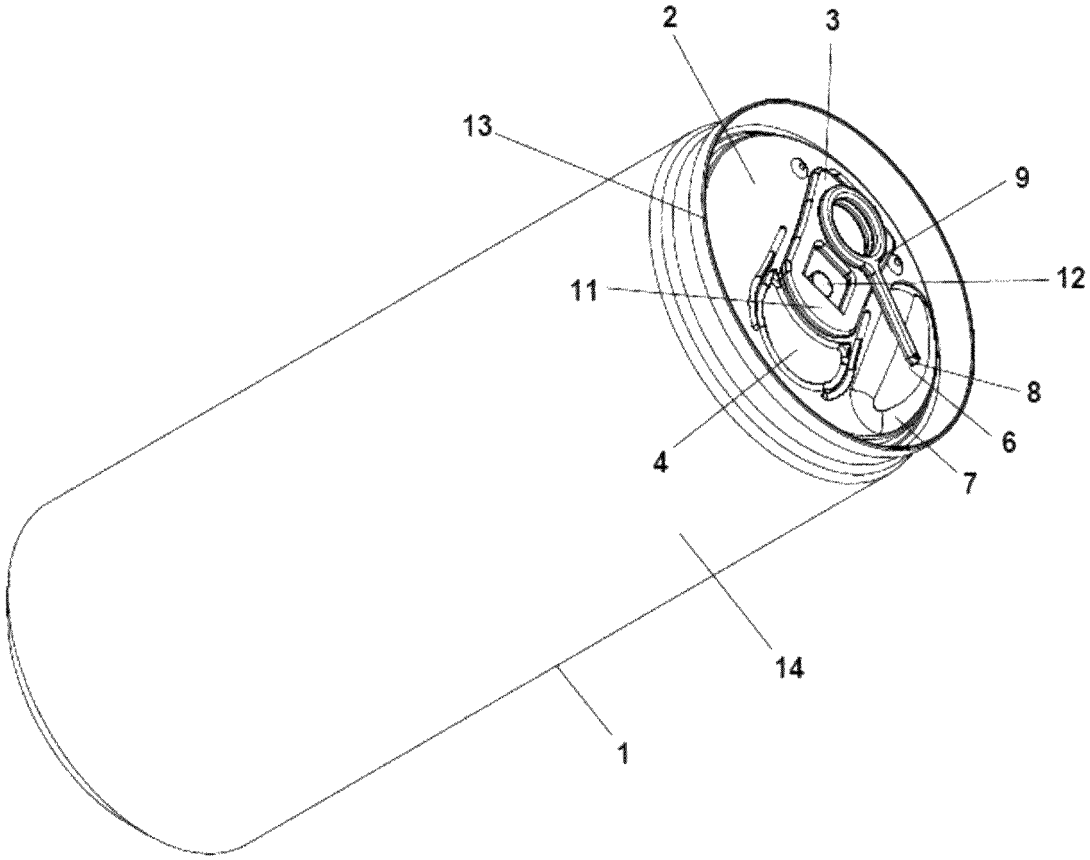

This application is a 371 of PCT Patent Application Ser. No. PCT/EP2015/002328, filed Nov. 20, 2015, which claims priority to German Patent Application Ser. No. 102014017320.8, filed Nov. 21, 2014.

The invention relates to a beverage container with a device for a promotional effect, in particular a beverage container with aerosol-emitting device.

For companies in competition it is essential to market their offered products and goods in a sales-promotional and sales-supporting fashion. For this purpose it is usual in particular in the field of the beverage industry that the design of the containers of the offered beverages is individually styled for the purpose of advertisement and promotion. This can be effected, for example, by an unusual or esthetically appealing shape or coloring of the beverage container, or also by prints or an effective placement of the brand name on the beverage container.

Likewise, beverage containers are equipped with devices for promotional effects, which may serve as promotional means or as a logo of the respective manufacturer. This promotional effect can be a visual effect, such as for example providing or visualizing a prize or gift, or an acoustic effect. Beverage containers having different promotional effects are known from the prior art.

EP 0 839 112 relates to a beverage can containing a prize or award. It discloses a beverage can where the drink as well as the prize and the device necessary for holding and taking out the prize are arranged in the interior thereof.

U.S. Pat. No. 5,056,659 discloses a beverage can which has a prize holding device or gift holding device arranged vertically in the interior of the can, which is positioned exactly below the drink-through opening. By actuating the pull tab the drink-through opening is opened and the gift holding device is partially pushed through the drink-through opening from the interior of the can for visualizing the prize or gift.

From the prior art there are also known so-called "floating widgets" for cans of beer, which are intended to cause a foaming as in freshly tapped beer. The "widget" located in the interior of the can is a plastic sphere filled with nitrogen under high pressure. When the can is opened the plastic sphere breaks, and the gas flowing out therefrom causes as an promotional effect a more creamy foaming.

Hence, materials must be employed for the devices being in contact with the beverage or prizes which are compatible with the beverage to be consumed, i.e. do not change the taste and/or color of the beverage or even make it inedible. Likewise, the device or the prize used must have the corresponding tightness.

Furthermore, the manufacturing process of the beverage cans mentioned above is more elaborate, because the often large device for the promotional effect must be mounted to or brought into the interior of the container during the manufacture. Likewise, this arrangement makes a replacement or a change of this device more difficult or has disadvantages, because the can must be opened. This is a problem in particular with beverage cans having one-way closures.

Moreover, some kinds of beverages are filled under a protective atmosphere, such as for example nitrogen, in order to prevent the contents from perishing.

A replacement of the device lying inside by means of opening the beverage container without loss of the protective atmosphere can hence not be effected in simple fashion.

Further devices for visual promotional effects can be, for example, sparklers which are attached to beverage cans or other food packaging as a sales-supporting measure. It must be ensured here that the promotional effect is not triggered during consumption of the beverage or food.

A known example of a device for an acoustic promotional effect is the swing top at beer bottles. Upon opening this closure, the characteristic "pop noise" can be perceived by the consumer. It is disadvantageous here that by merely replacing the swing top, for example in the case of a defect, at the same time the beer bottle is opened too.

The invention is based on the object of providing a beverage container having a device for a promotional effect, which avoids the disadvantages mentioned above.

The invention is further based on the object of providing a beverage container having a device for a promotional effect, which guarantees the taste, the color and the edibility of the beverage.

It is a further object of the invention to provide a beverage container having a device for a promotional effect, which prevents a premature and unintentional triggering of the promotional effect, in particular during the consumption of the beverage.

It is a further object of the invention to provide a beverage container having a device for a promotional effect, where the device is suitable for acoustic, olfactory and/or visual promotional effects and is replaceable in simple and fast fashion.

The invention is based on the finding that all objects mentioned above can be achieved by an aerosol-emitting device attached to an outer side of the beverage container and a triggering device.

Subject matter of the invention is a beverage container with aerosol-emitting device, comprising an opening device arranged on an outer side of the beverage container for opening a drink-through opening cover and an aerosol-emitting device attached to an outer side of the beverage container, which aerosol-emitting device comprises a pressure container for receiving and storing a pressurized propellant gas and a substance to be emitted, a nozzle fluidly connected to the pressure container for emitting an aerosol formed from the propellant gas and the substance to be emitted, and a triggering device for opening the nozzle, which releases the aerosol upon actuation.

The beverage container according to the invention has numerous advantages. Since the aerosol-emitting device is attached to the outer side of the beverage container, the elaborate step of incorporating and mounting the device into the interior of the container during the manufacture of the same is eliminated. The installation of the device may advantageously be effected after finishing and filling the beverage container. The installation of the device can advantageously also be effected in a premanufactured lid or in a premanufactured bottom of the beverage container.

The arrangement of the aerosol-emitting device at the outer side further has the advantage that the device cannot come into any contact with the beverage located in the container. A discoloration, a change of the flavor or any other contamination of the beverage caused by the aerosol-emitting device itself or the substances or propellant gases located therein can be excluded.

The arrangement of the aerosol-emitting device at the outer side further has the advantage that the device can be exchanged in simple and fast fashion. This is the case, for example, when the device is defect. Likewise, a separate recycling of the aerosol-emitting device and the remaining beverage container is not necessary.

Moreover, in case of a replacement or change of the aerosol-emitting device the protective atmosphere in the interior of the beverage container, if present, advantageously remains undisturbed.

Another advantage of the invention is that the beverage container according to the invention additionally has, besides the opening device for opening the drink-through opening cover, a triggering device which upon actuation releases the aerosol, i.e. triggers the promotional effect. With this additional triggering device the promotional effect can be triggered without the drink-through opening of the beverage container being opened.

It is further an advantage of the invention that the aerosol-emitting device is suitable for acoustic, olfactory and/or visual promotional effects. The substance to be emitted, which together with the propellant gas forms the aerosol, can be selected as needed such that the aerosol emitting from the nozzle is perceptible olfactorily and/or visually. With a corresponding configuration of the nozzle, the aerosol can also be perceived acoustically, for example as a whistling or fizzling noise.

Preferably, the opening device and/or the aerosol-emitting device are arranged at the top side of the beverage container or at the bottom of the beverage container. However, the opening device and/or the aerosol-emitting device can also be arranged at a side wall of the beverage container or in an inwardly bulged bottom of the beverage container. The opening device can be, for example, a strap, a lever or a screw closure. The drink-through opening cover can be, for example, a lid, for example made of plastic or metal sheet, or a cling film. A combination of opening device and drink-through opening cover can be, for example, a stay-on-tab closure, a simply-pull closure or a ring-pull closure which are all well-known from the prior art.

A particularly good stackability of the beverage container according to the invention results from the aerosol-emitting device being arranged preferably in a recess of the top side of the beverage container or in a recess at the bottom of the beverage container. The recess is configured preferably such that it can completely accommodate the aerosol-emitting device and the aerosol-emitting device thus does not protrude from the recess.

However, the recess can also be configured such that merely a part of the aerosol-emitting device is accommodated in the recess and the remaining part projects out of the recess. In this case, for example, the pressure container can be completely accommodated in the recess and merely the nozzle and the triggering device protrudes from the recess.

The recess may be located centrally or centered on the top side or at the bottom of the beverage container, or may also be located in the edge area on the top side or at the bottom of the beverage container.

The triggering device for opening the nozzle can be, for example, a plug, a screw closure, a lever, a strap or a bracket.

The nozzle is usually a tube, for example, a round tube or square tube. In the simplest case, the nozzle can also be an opening in the pressure container.

In a preferred embodiment the nozzle at its end opposing the pressure container is breakably connected to a cap, the cap sealing the nozzle in gas-tight fashion. This prevents a premature and unintentional escape of the propellant gas and the substance to be emitted and at the same time the pressure of the propellant gas in the pressure container is maintained. Breakably connected means that the cap can be broken off the end of the nozzle by the action of mechanical force caused by the consumer, for example by rotating, folding, tilting, drawing off, tearing off, shearing off or lifting the cap. Breakably connected also means, however, that the cap can be broken off the end of the nozzle by triggering a corresponding mechanical device. For example, the cap can be knocked or broken off by a biased spring arranged at the beverage container. In this embodiment, the cap is preferably firmly connected to the triggering device. The firm connection between cap and triggering device may be effected, for example, by soldering or glueing together. In an embodiment, the cap is formed integrally with the triggering device. Preferably, the breakable connection between the nozzle and the cap has at least one rated breaking point which breaks when the triggering device is actuated. Such a rated breaking point is, for example, a score or notch. The incorporation of a rated breaking point facilitates breaking open the breakable connection between the nozzle and the cap upon actuation of the triggering device.

The aerosol flowing out from the nozzle is to be perceptible by the consumers in olfactory, acoustic and/or visual fashion. The aerosol is formed by whirling and mixing the propellant gas and the substance to be emitted in the pressure container and/or the nozzle. The pressure container as well as the fluidly connected nozzle act here as a whirl chamber or whirl room. Forming the aerosol is thus effected by dispersion of the substance(s) to be emitted in the propellant gas or propellant gas mixture.

Preferably, non-toxic, inodorous and/or low-odour gases are used as a propellant gas. It is further preferred that the propellant gas is inert and does not chemically react with the substance to be emitted. Preferably, the propellant gas is air, $N_2$, $N_2O$, $CO_2$, $O_2$ or mixtures thereof.

The aerosol can be perceived acoustically by the consumer. Preferably, the nozzle is formed such that the aerosol emitting from the nozzle is acoustically perceptible. For example, the nozzle may have an edge at its inner side, thereby causing the aerosol to make a whistling noise upon flowing out from the nozzle.

The substance to be emitted is preferably non-toxic and inert. Further, the substance to be emitted can be a liquid, a solid substance, such as for example particles with an average diameter of $10^{-7}$ to $10^{-3}$ cm, or mixtures thereof. It must be possible to disperse the substance to be emitted in the propellant gas, so that an aerosol can be formed.

Preferably, the substance to be emitted includes scents, odorous substances, colorants, water or mixtures thereof. Scents are naturally occurring scents, in particular herbal scents, such as for example scents of plants like roses, lavender, vanilla, citrus, eucalyptus and the like. Odorous substances are synthetic scents, such as for example menthol, vanillin, cinnamon aldehyde or the like. When scents and/or odorous substances are used, the aerosol emitting from the nozzle is perceived by the consumer, for example, as "a fragrance cloud."

As colorants there are preferably used food colorants, such as for example curcumin (E100), orange yellow S (E110), carotin (E160a), carmine (E120), indigotine (E132), green S (E142), brilliant black BN (E151), titanium dioxide (E171) or mixtures thereof. Food colorants which are easily removable from clothing, textiles and surfaces, in particular those which sublimate residue-free or evaporate, are preferred. Accordingly, when colorants are used, the aerosol is visually perceived by the consumer, for example as "a color cloud".

Preferably, the propellant gas in the pressure container is under a pressure of 1.25 to 18 bar, more preferably under a pressure of 1.5 to 15 bar, still more preferably under a pressure of 1.75 to 12 bar, still more preferably under a pressure of 2 to 9 bar, still more preferably under a pressure of 2.5 to 6 bar and most preferably under a pressure of 3 to 4 bar.

The pressure container preferably has a volume of 0.5 to 10 $cm^3$, more preferably a volume of 0.75 to 8 $cm^3$, still more preferably a volume of 1 to 6 $cm^3$, and most preferably a volume of 2 to 4 $cm^3$.

Preferably, the amount of propellant gas introduced into the pressure container is selected such that the formed aerosol is emitted from the nozzle for a time period of 0.5 to 10 s, more preferably 1 to 8 s, still more preferably 1.5 to 6 s, and most preferably 2 to 4 s.

For preventing a premature opening of the drink-through opening cover before the aerosol is released, the opening device is preferably unlocked by actuation of the triggering device. Unlocking means that the actuation of the opening device is made possible for the consumer only after the actuation of the triggering device. For example, the triggering device can be arranged on the beverage container such that when viewed spatially it is located directly above the opening device or extends over the opening device. The consumer can hence neither reach the opening device nor can he actuate it. Only after the actuation of the triggering device, such as for example by rotating or lifting the same, the opening device lying thereunder or arranged thereunder is accessible to the consumer or "unblocked". Thereafter, the consumer can then actuate the opening device.

With such a mechanical lock it is ensured that first the triggering device must be actuated in order to release the aerosol, and only thereafter the opening device is actuatable to open the drink-through opening cover, and the user can consume the beverage.

For this purpose it is hence preferred that the aerosol-emitting device is located directly next to or near the opening device.

Preferably, the pressure container consists of plastic material, metal or a combination therefrom. Preferably, the pressure container is constructed from metal, because this has a higher mechanical stability, and therefore the propellant gas can be received and stored with a higher pressure in comparison to plastic containers. The metal can be, for example, steel or aluminum. The pressure container can basically assume any shape, and can be designed, for example, spherical, ellipsoidal, kidney-shaped, cubical or cuboid.

The beverage container consists preferably of metal, cardboard, glass, Tetra Pak, plastic material or combinations thereof. In a preferred embodiment, the beverage container is made of metal. The metal can be, for example, tin plate or aluminum. The beverage container can assume a cylindrical shape, such as for example a can, a cubic or cuboid shape, the cylindrical form being preferred.

Further details, features and advantages of the subject matter of the invention will emerge from the following description of the appurtenant figures, in which preferred embodiments of the invention are represented by way of example.

Figure 2:
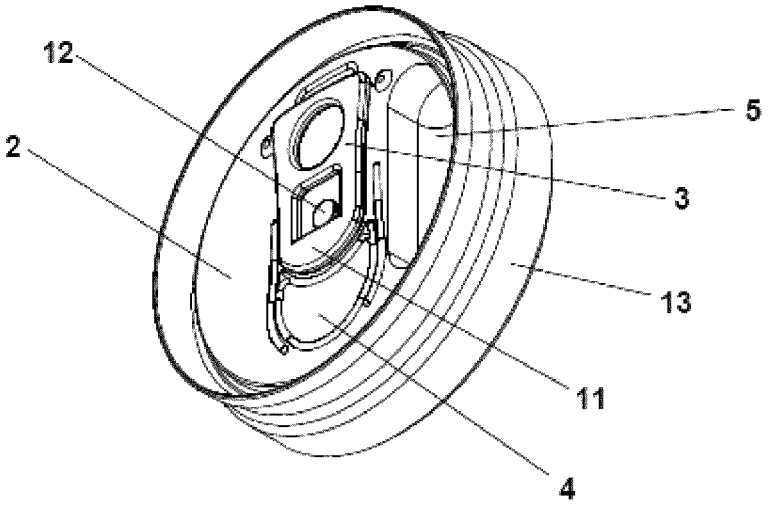
Figure 3:
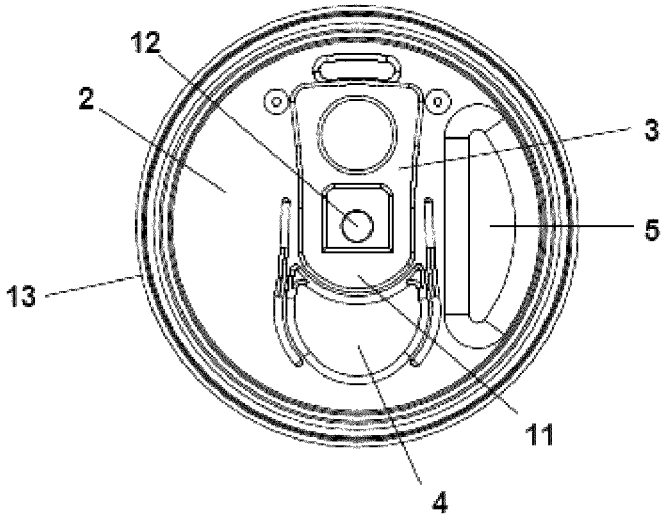
Figure 4:
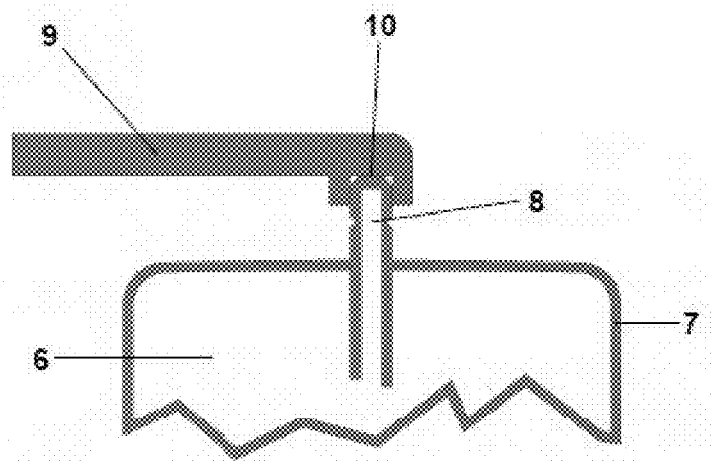
Figure 5:
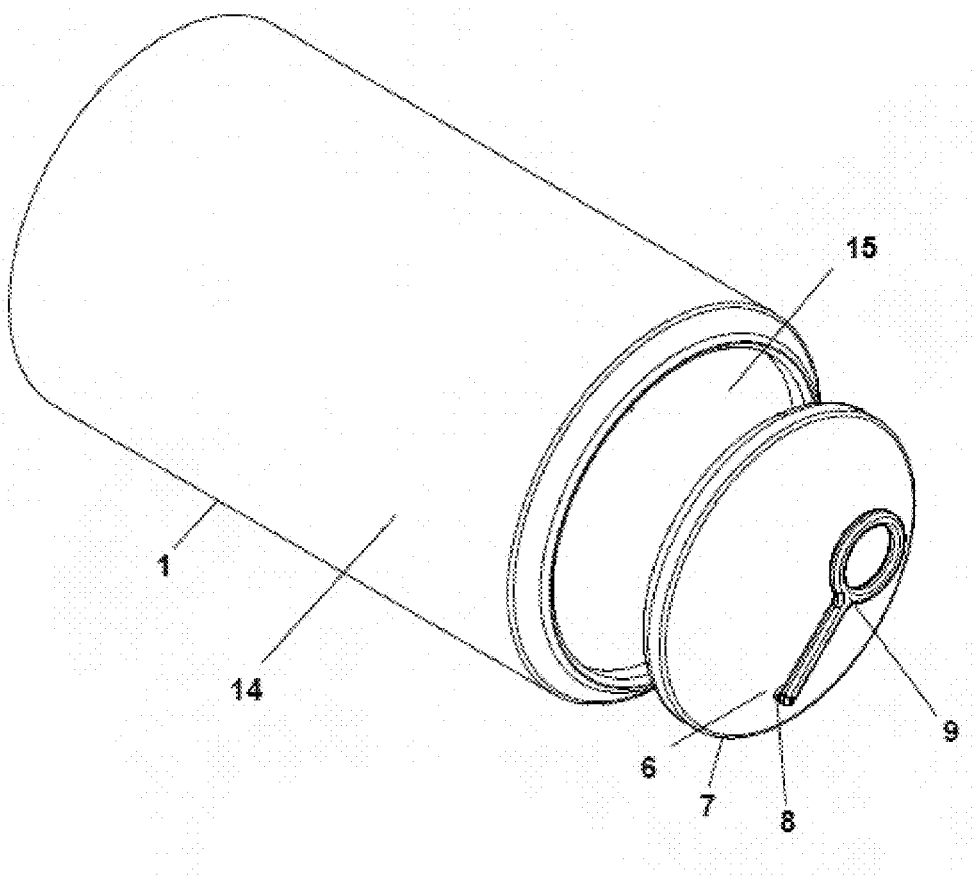

Therein are shown:

FIG. 1 a perspective view of an embodiment of the beverage container with aerosol-emitting device according to the invention, FIG. 2 a perspective view of a lid of the beverage container according to the invention with recess and detached pressure container, FIG. 3 a plan view of the lid of the beverage container according to the invention of FIG. 2 with recess and detached pressure container, FIG. 4 a side view of an aerosol-emitting device of the beverage container according to the invention, and FIG. 5 a perspective view of another embodiment of the beverage container according to the invention with an aerosol-emitting device arranged in the inwardly bulged can bottom of the beverage container.

FIG. 1 shows a perspective view of a beverage container (1) according to the invention in the form of a cylindrical beverage can made of tin plate. The beverage container has, as evident also from FIGS. 2 and 3, at its top side (2) an opening apparatus (3) arranged centrally and centered. The opening apparatus (3) in this embodiment example is configured as a pull tab which is rotatably fixed on the top side (2) of the beverage container (1) by means of a rivet (12).

The pull tab has an extension (11) which upon lifting the pull tab presses the scored drink-through opening cover (4) into the interior of the beverage container (1) and thus produces a drink-through and pouring opening. This kind of opening device (3) and the drink-through opening cover (4) is also known from the prior art as "stay-on-tab".

As evident from FIGS. 1 to 3, the top side (2) has an elongate, kidney-shaped recess (5) between the opening device (3) and the edge (13) of the beverage container (1). The recess (5) and the pressure container (7) are configured to be compatible with each other in shape and size. The pressure container (7) can hence be completely accommodated in the recess (5), so that the top side of the pressure container (7) is flush with the top side (2) of the beverage container (1).

In this example, the pressure container (7) is made of aluminum. Its volume is 2 $cm^3$ and is filled with compressed air at a pressure of 2 bar. Further, liquid water is located in the pressure container (7) as a substance to be emitted. As also evident from FIG. 4, on the top side of the pressure container (7) there is arranged a tubular nozzle (8) which is fluidly connected to the pressure container (7). The nozzle (8) is breakably connected to the cap (10). This connection has a rated breaking point in the form of a circumferentially running notch.

The triggering device (9) is configured here as a lever with strap, which with its end opposing the strap is firmly connected to the cap (10). As evident from FIG. 1, the triggering device (9) is here positioned such that the strap of the triggering device (9) is spatially arranged exactly above the pull tab of the opening device (3) and thus locks the opening device (3). As evident from FIG. 1, the pull tab cannot be lifted or actuated until the lever of the triggering device (9) is actuated. Hence, the consumer must first actuate the triggering device (9), in this case rotate the lever clockwise or counter-clockwise or lift the lever. By this actuation of the triggering device (9) the connection between cap (10) and nozzle (8) breaks, the triggering device (9) together with the cap (10) detaches from the nozzle (8) and opens it.

By the opening of the nozzle (8) the compressed air located in the pressure container (7) flows through the opened nozzle (8) out of the pressure container (7). This leads to the whirling and mixing of the compressed air with the liquid water in the pressure container (7) as well as in the nozzle (8). The pressure container (7) as well as the nozzle (8) act here as a whirl chamber or whirl room. Individual water droplets are entrained in the flowing compressed air and dispersed therein, and an aerosol is formed. The aerosol flows out from the nozzle (8) and is visible to the consumer as a fog fountain.

After actuating the triggering device (9) and after releasing the aerosol as a fog fountain the consumer can then actuate the pull tab of the opening device (3), which has become accessible, for opening the drink-through opening cover (4) and producing a drink-through or pouring opening.

FIG. 5 shows a further embodiment of the beverage container (1) according to the invention. In this embodiment, the aerosol-emitting device (6) is arranged at the inwardly bulged bottom (15) of the beverage container (1). The pressure container (7) of the aerosol-emitting device (6) is formed such that it can be completely lowered into the bottom (15) of the beverage container (1) or accommodated therein. In this example, too, at the pressure container (7) there is arranged a tubular nozzle (8) which is fluidly connected to the pressure container (7). The triggering device (9) is configured also as a lever with strap here.

LIST OF REFERENCE SIGNS

1 beverage container
2 top side of the beverage container (1)
3 opening device
4 drink-through opening cover
5 recess
6 aerosol-emitting device
7 pressure container
8 nozzle
9 triggering device
10 cap
11 extension
12 rivet
13 edge of the beverage container (1)
14 side wall of the beverage container (1)
15 bottom of the beverage container (1)

The invention claimed is:

1. A beverage container with aerosol-emitting device, comprising an opening device (3) arranged on an outer side of the beverage container (1) for opening a drink-through opening cover (4) and an aerosol-emitting device (6) attached to an outer side of the beverage container (1), which aerosol-emitting device comprises a pressure container (7) for receiving and storing a pressurized propellant gas and a substance to be emitted, a nozzle (8) fluidly connected to the pressure container (7) for emitting an aerosol formed from the propellant gas and the substance to be emitted, and a triggering device (9) for opening the nozzle (8) which releases the aerosol upon actuation, characterized in that an end of the nozzle (8) opposing the pressure container (7) is breakably connected to a cap (10) and the cap (10) seals the nozzle (8) in gas-tight fashion and the cap (10) is firmly connected to the triggering device (9).

2. The beverage container according to claim 1, characterized in that the opening device (3) and/or the aerosol-emitting device (6) are arranged at the top side (2) of the beverage container (1) or at a bottom (15) of the beverage container (1).

3. The beverage container according to claim 2, characterized in that the aerosol-emitting device (6) is arranged in a recess (5) of the top side (2) of the beverage container (1) or in a recess at the bottom (15) of the beverage container (1).

4. The beverage container according to claim 1, characterized in that the breakable connection between the nozzle (8) and the cap (10) has at least one rated breaking point which breaks by actuation of the triggering device (9).

5. The beverage container according to claim 1, characterized in that the propellant gas is air, $N_2$, $N_2O$, $CO_2$, $O_2$ or mixtures thereof.

6. The beverage container according to claim 1, characterized in that the substance to be emitted includes scents, colorants, water or mixtures thereof.

7. The beverage container according to claim 1, characterized in that the amount of propellant gas introduced into the pressure container (7) is selected such that the formed aerosol is emitted from the nozzle (8) for a time period of 0.5 to 10 s.

8. The beverage container according to claim 1, characterized in that the opening device (3) is unlocked by actuation of the triggering device (9).

9. The beverage container according to claim 1, characterized in that the propellant gas in the pressure container (7) is under a pressure of 1.25 to 18 bar.

10. The beverage container according to claim 1, characterized in that the pressure container (7) has a volume of 0.25 to 10 $cm^3$.

11. The beverage container according to claim 1, wherein the opening device is a strap, a lever, a screw closure, or a pull tab.

12. The beverage container according to claim 1, wherein the triggering device is a plug, a screw closure, a lever, a strap, or a bracket.

13. The beverage container according to claim 3, wherein the nozzle and the triggering device protrude from the recess.

14. The beverage container according to claim 1, wherein the triggering device is actuated by rotating or lifting the triggering device.

15. The beverage container according to claim 1, wherein the pressure container has a spherical, ellipsoidal, kidney-shaped, cubical, or cuboid shape.

16. The beverage container according to claim 1, wherein the pressure container is constructed from metal.

17. The beverage container according to claim 1, wherein the beverage container has a cylindrical, cubic, or cuboid shape.

18. The beverage container according to claim 1, characterized in that the propellant gas in the pressure container (7) is under a pressure of 2.5 to 6 bar.

19. The beverage container according to claim 1, characterized in that the pressure container (7) has a volume of 2 to 4 $cm^3$.

* * * * *